United States Patent [19]

Weston et al.

[11] 4,060,108

[45] Nov. 29, 1977

[54] VAPOR CONTROL SPOUT

[75] Inventors: Paul George Weston, La Crescenta, Calif.; Glenn A. Jennemann, St. Louis, Mo.; Thomas Kemp Hutchinson, Godfrey, Ill.

[73] Assignee: Milton D. Hartman, St. Louis, Mo.

[21] Appl. No.: 647,911

[22] Filed: Jan. 9, 1976

[51] Int. Cl.[2] ..... B65B 31/06

[52] U.S. Cl. ..... 141/59; 141/311 R; 141/392; 285/131; 285/356

[58] Field of Search ..... 141/52, 59, 93, 98, 141/97, 290, 392, 310, 311 R; 285/131, 356

[56] References Cited

U.S. PATENT DOCUMENTS

| | | | |
|---|---|---|---|
| 2,214,708 | 9/1940 | Mayne et al. | 141/392 X |
| 3,581,782 | 6/1971 | Onufer | 141/59 |
| 3,748,829 | 7/1973 | Joyce et al. | 141/59 X |
| 3,826,291 | 7/1974 | Steffens | 141/59 |
| 3,830,267 | 8/1974 | Cass | 141/290 X |
| 3,866,636 | 2/1975 | Lasater | 141/59 |

*Primary Examiner*—Richard E. Aegerter
*Assistant Examiner*—Frederick R. Schmidt
*Attorney, Agent, or Firm*—Rogers, Eilers & Howell

[57] ABSTRACT

A spout for a gasoline nozzle providing vapor control for gasoline vapor produced during the filling of a vehicle tank. The spout includes a curved rigid tube having an inlet end for attachment to an outlet of a gasoline nozzle and an outlet end adapted to extend into the mouth of a fill tube of a vehicle tank. A rigid housing surrounds the tube and has a rearward end in sealing engagement about the tube, a forward end and a vapor outlet port. The housing defines, with the wall of the tube, a vapor receiving chamber therebetween. Vapor passages are located at the forward end of the housing which communicates with the chamber and the port as well as with the vehicle tank. The forward end of the housing is supported by a sleeve having a rearward end which extends into the forward end of the housing and a forward end that extends into the fill tube of the tank, the forward end of the sleeve having openings for the receipt of vapor from the tank which communicate with said passages. A lock pin at the rearward end of the housing engages the housing and the tube to secure the rearward end of the housing on the tube. The forward end of the sleeve is sized to draw air from outside the vehicle tank as well as vapor from within the tank.

8 Claims, 7 Drawing Figures

Fig. 1.
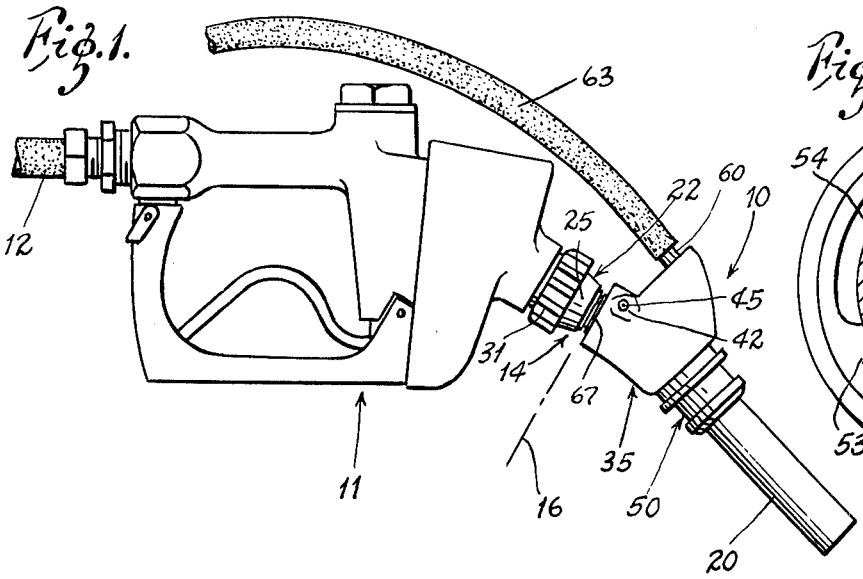
Fig. 3.
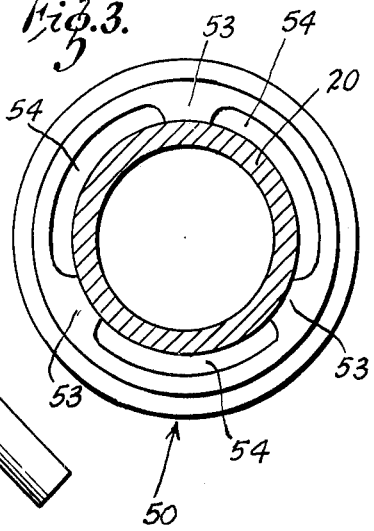
Fig. 2.
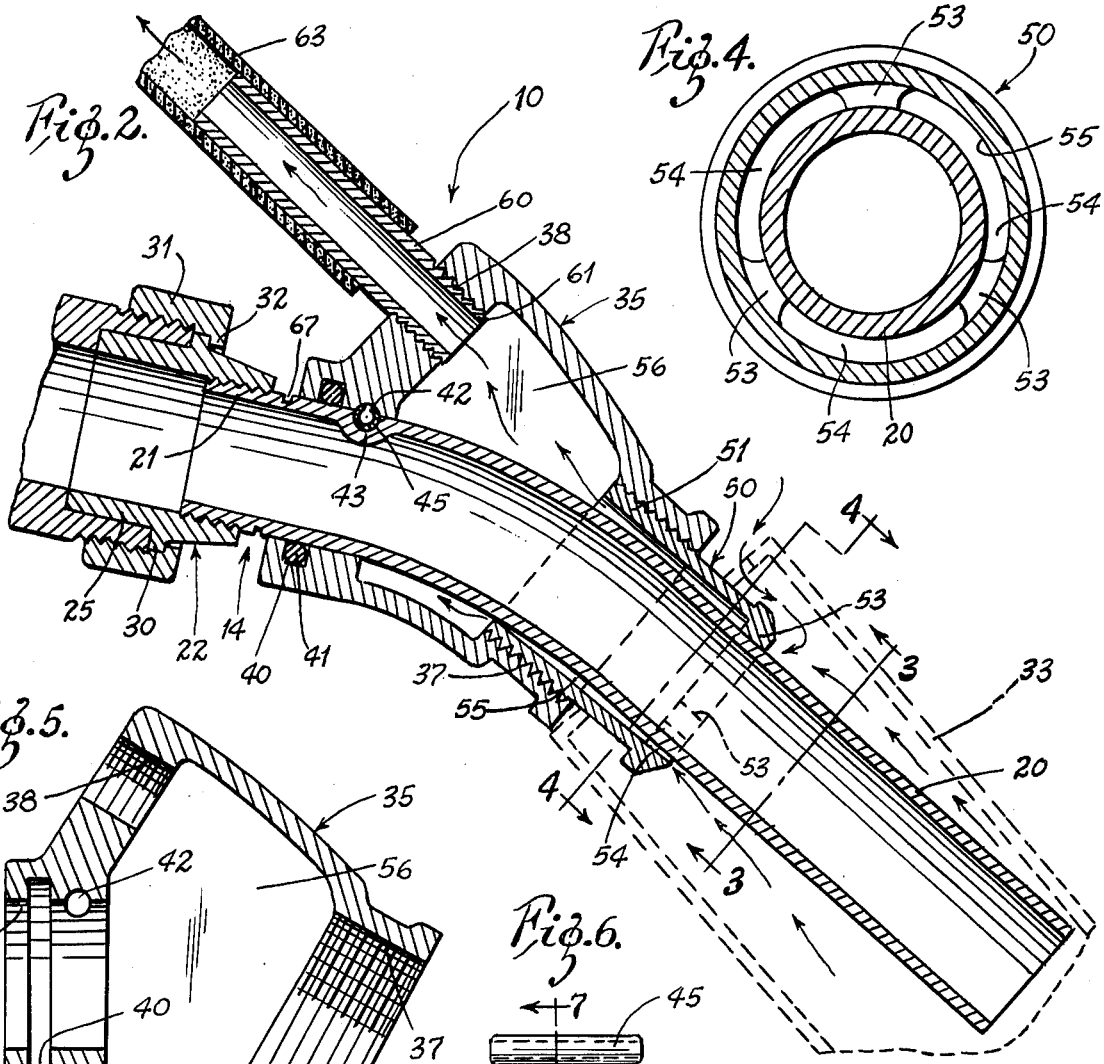
Fig. 4.
Fig. 5.
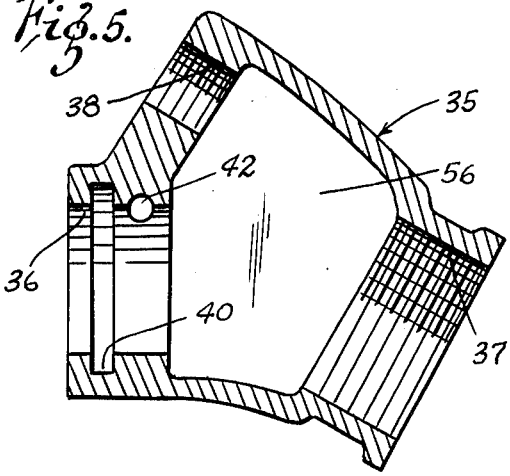
Fig. 6.
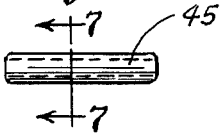
Fig. 7.
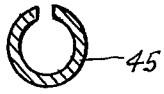

VAPOR CONTROL SPOUT

SUMMARY AND BACKGROUND OF THE INVENTION

This invention relates to a spout for a vapor control nozzle for use in conjunction with a gasoline pump for filling the fuel tanks of vehicles, and for the control of gasoline vapor created thereby.

Vapor recovery nozzles are known in the art and commonly include a tubular portion that extends into the mouth of the fill tube of the vehicle tank, and a member that fits in sealing engagement with the mouth of the fill tube during the filling operation. By this arrangement, vapor in the vehicle tank displaced by the gasoline pumped into the tank is forced into a vapor receiving cavity and then through a vapor conduit to an appropriate receiving tank by means of a vapor pump or some other means to facilitate the flow of vapor out of the vehicle tank.

Some of these known devices require special nozzles having return channels therein for the vapor, while others use a standard nozzle with a replacement spout. But, even in the latter instance it has been found that the adapters or replacement spouts are undesirably complex in design and may include relatively complex spring loaded valves to facilitate the sealing engagement of the spout with the full tube of the vehicle.

The improved vapor control spout of this invention provides a replacement spout for attachment to a standard nozzle and one which receives the dispalaced vapor from the vehicle tank along with air from outside the tank by means of a loose fitting arrangement between the spout and the fill tube of the vehicle tank. This provides an exceptionally efficient vapor control system by means of a spout which is uniquely simple in design and installation.

Generally, the vapor control spout of this invention attaches to a standard nozzle having the necessary valves and handle for operating the valves in a manner well known in the art, the spout having means for evacuating the vapor from the vehicle tank and mixing it with air as the tank is filled. The spout includes a curved tube having one end attached to the output end of the nozzle, the other end designed to extend into the mouth of the vehicle tank. The tube extends through a housing, the rearward end of the housing being in sealing engagement with the outer surface of the tube, the wall of the housing and the wall of the tube defining a vapor receiving cavity or chamber therebetween. The forward end of the housing is attached to the tube by means of a sleeve having a vapor receiving openings therein which communicate with the vapor receiving chamber. The housing has an outlet port that communicates with the cavity and which receives a fitting for a vapor conduit. The sleeve fits loosely in the mouth of the vehicle tank fill tube whereby vapor from the tank and air from outside the tank are drawn by means of a vacuum pump, or the like, into the vapor receiving cavity and out the vapor conduit.

In accordance with the unique construction of the vapor control spout of this invention, the housing is held in place at one end by the wedging action of the sleeve on the curved tube and at the other end by a locking pin, thereby providing a spout adapter that is easy to install and yet of sound construction.

Thus, it is the general object of this invention to provide a spout adapter for the control of gasoline vapor which will fit a standard gasoline nozzle, which provides loose engagement of the adapter with the fill tube of the vehicle tank for the evacuation of vapor from the tank mixed with air from outside the tank, and which is uniquely simple and yet sound in construction, and easy to install.

These and other objects of the invention will become apparent from the drawings and detailed description to follow.

DESCRIPTION OF THE DRAWINGS

FIG. 1 is a side elevation view of the vapor control spout adapter of this invention as shown attached to a standard gasoline nozzle;

FIG. 2 is a section view of the nozzle adapter portion of FIG. 1;

FIG. 3 is an enlarged view in section taken generally along the line 3—3 of FIG. 2;

FIG. 4 is an enlarged view in section taken generally along the line 4—4 of FIG. 2;

FIG. 5 is an enlarged sectional view of the housing portion of the nozzle adapter of FIG. 1;

FIG. 6 is a side elevation view of the lock pin for locking the rearward portion of the housing to the spout tube; and FIG. 7 is an enlarged view in section taken generally along the line 7—7 of FIG. 6.

DETAILED DESCRIPTION OF A PREFERRED EMBODIMENT

In the drawing there is shown a spout adapter 10 of this invention attached to a standard gasoline nozzle 11 including appropriate valve and valve levers for the dispensing of gasoline. A hose 12 at the input of the nozzle feeds gasoline from an appropriate pump and to an outlet end 14 when the nozzle is operated in a manner to open the appropriate valves therein, all of which is well known in the art. That portion of FIG. 1 behind the line 16 represents a nozzle of a type commonly known, and therefore the details of the nozzle need not be described.

The spout adapter 10 attaches to the outlet 14 and includes a curved, rigid tube 20 having an externally threaded rearward end 21 which is attached to the outlet 14 of the nozzle 11 by means of a standard coupling 22. The coupling 22 is actually part of the nozzle 11 and is of a type for attaching a conventional spout, of a type commonly known in the art, without a vapor control capability. Such commonly known spouts are very similar to the tube 20 itself. Thus, the coupling 22 includes a sleeve 25 having a threaded portion that engages the threaded end 21 of the tube 20 and a portion that extends within the outlet of the nozzle 11. The sleeve 25 has an annular shoulder 30. A threaded ring 31 screws onto the threaded outlet of the nozzle 11 and has a shoulder 32 which engages the shoulder 30 to secure the sleeve 25 in place. The forward or outlet end of the tube 20 is adapted to extend into the fill tube 33 of a vehicle tank.

A rigid housing 35 fits about the tube 20 at the location of the curved portion of the tube, the housing 35 having a rearward opening 36, a forward internally threaded opening 37, and an internally threaded vapor outlet port 38. The opening 36 has an annular groove 40 that receives an O-ring 41 which acts in sealing engagement with the outer wall of the tube 20 near the nozzle outlet. Just forward of the groove 40 is a hole 42 extending transversely through the housing 35, the hole extending partially into the opening 36. The tube 20 has a transverse groove or recess 43 aligned with the hole 42, and a lock pin 45 extends through the hole 42 with the central portion of the pin extending downwardly into the groove 43 to firmly lock the housing 35 onto the tube 20.

The forward end 37 of the housing 35 is secured in place by means of a sleeve 50 having a rearward externally threaded portion 51 which screws into the threaded opening 37. The forward end of the sleeve 50 has inwardly directed shoulders 53, the inner surfaces of which engage the outer surface of the tube 20. The shoulders 53 are separated by openings 54 at the forward end of the sleeve 50 which communicate with an annular passage 55 formed between the sleeve 50 and the tube 20. A vapor receiving cavity 56, formed between the wall of the housing 35 and the tube 20 communicates with the passage 55 and the openings 54.

The sleeve 50 is threaded into the opening 37 of the housing 35 at a location of the curved portion of the tube 20. Because of the slight curve in the tube 20 at the location of the sleeve 50 and opening 37, the axes of the sleeve and opening become somewhat out of alignment as the sleeve is inserted. Thus, as the sleeve 50 is tightened with the opening 37, it binds and becomes wedged due to its engagement with the opening 37 and curved portion of the tube. This wedging or binding effect solidly supports the forward end of the housing 35.

A fitting 60 having an externally threaded end 61 screws into the vapor outlet port 38 of the housing 35, a vapor conduit 63, such as a rubber hose or the like, being attached thereto. The other end of the hose 63 is connected to a suitable vacuum pump or other device (not shown) for creating a suction in a manner commonly known in the art.

The sleeve 50 is sized smaller in diameter than the fill tube, and extends therein preferably a minimum distance of approximately ¾ inch to 1 inch for efficient mixing of air and vapor.

The tube 20 has an annular groove 67 between the housing 35 and the coupling 22 to provide a safety break-off location forward of the nozzle 11 as is well known in the art.

Operation of the spout adapter of this invention is apparent from the foregoing description. The forward end of the sleeve 50 is sized to provide a space between it and the mouth of the vehicle fill tube and to extend therein. As gasoline is pumped through the tube 20 into the tank, gasoline vapor is drawn, by means of the suction created in the chamber 56, from the tank and into the openings 54. Air from outside the tank is also drawn between the sleeve 50 and the fill tube into the openings 54. The air and vapor mixture is drawn through the passage 55 and into the chamber 56, whereupon it is then drawn out the tube 63. The O-ring 42 acts as a seal against the passage of vapor between the tube 20 and the rearward end of the housing 35, and the pin 45 and sleeve 50 act to hold the housing 35 securely in place about the tube 20.

Thus, there has been described a vapor control spout adapter which fulfills the objects of this invention.

Various changes and modifications may be made in this invention, as will be readily apparent to those skilled in the art. Such changes and modifications are within the scope and teaching of this invention as defined by the claims appended hereto.

We claim:

1. A spout for a gasoline nozzle comprising a curved, rigid tube, an inlet end of the tube having means for attachment to the outlet end of a nozzle, an outlet end of the tube being adapted to extend into the mouth of a fill tube of a vehicle fuel tank, a rigid housing surrounding said tube, said housing having a rearward end, a forward end, and a vapor outlet port, said housing defining with an outer wall of said tube a vapor receiving chamber therebetween, said chamber having passage means communicating with said port, means providing sealing engagement of the rearward end of said housing about said tube at a first position on the tube, a wedge sleeve adjustably engaged to the forward end of the housing for movement relative to the housing to engage and bind a rear sleeve portion against the tube at a second position on the tube forward of the first position on the tube and curved away from the first position on the tube, said wedge sleeve having an engaging surface in a forward sleeve portion acting with said rear sleeve portion on said tube to support the forward end of said housing on the tube, said engaging and binding at the second position on the tube occurring when the housing has said rearward end sealingly engaged about the tube at said first position on the tube, said wedge sleeve having means forming a vapor passage between said sleeve and said tube to communicate said vehicle tank with said chamber.

2. The spout of claim 1 wherein the rear portion of said sleeve extends into the forward end of said housing in threaded engagement therewith.

3. The spout of claim 1 wherein said housing further includes a transverse hole at its rearward end, and wherein said tube has a transverse recess in its outer wall in alignment with said hole, said spout further comprising a lock pin extending through said hole and into said recess.

4. The spout of claim 1 further comprising a vapor conduit attached to said port for the passage of vapor therethrough from said chamber.

5. The spout of claim 1 wherein said sleeve is sized to be of smaller diameter than the fill tube of the vehicle tank and extends into the mouth of the fill tube, whereby suction means creates a suction in said chamber drawing vapor from said tank and air from outside said tank into said upon passage means.

6. The spout of claim 5 wherein said sleeve is adapted to extend into the mouth of the fill tube a minimum of approximately ¾ to 1 inch.

7. A spout for a gasoline nozzle comprising a curved, rigid tube, an inlet end of the tube having means for attachment to the outlet end of the nozzle, an outlet end of the tube being adapted to extend into the mouth of a fill tube of a vehicle fuel tank, a rigid housing surrounding said tube, said housing having a rearward end, a forward end, and a vapor outlet port, said housing defining with an outer wall of said tube a vapor receiving chamber therebetween, said chamber having passage means communicating with said port, means providing sealing engagement of the rearward end of said housing about said tube at a first position on said tube, a wedge sleeve adjustably attached to the forward end of said housing for movement relative to the housing to engage and bind a rear sleeve portion against the tube at a second position on the tube forward of the first position on the tube and curved away from the first position on the tube, said wedge sleeve having an engaging surface in a forward sleeve portion acting with said rear sleeve portion on said tube to support the forward end of said housing on the tube, said engaging and binding at the second position on the tube occurring when the housing has said rearward end sealingly engaged about the tube at said first position on the tube, said sleeve having openings at its forward portion for receipt of vapor from the vehicle tank, and having vapor passage means associated therewith in communication with said openings and communicating said chamber with the vehicle tank, said sleeve being sized to be of smaller diameter than the fill tube of the vehicle tank and extending into the mouth of the fill tube to define an opening between said sleeve and the mouth of said fill tube, whereby suction means creates a suction in said chamber drawing vapor from said tank into said openings at the forward portion of the sleeve and drawing air from outside said tank through said opening between the sleeve and the mouth of the fill tube and into said openings at the forward portion of said sleeve.

8. A spout for a gasoline nozzle comprising a curved, rigid tube, an inlet end of the tube having means for attachment to the outlet end of a nozzle, an outlet end of the tube being adapted to extend into the mouth of a fill tube of a vehicle fuel tank, a rigid housing surrounding said tube, said housing having a rearward end, a forward end, and a vapor outlet port, said housing defining with an outer wall of said tube a vapor receiving chamber therebetween, said chamber having passage means communicating with said port, said housing having an opening in its rearward end to receive a rear part of the tube and the housing having a sleeve portion positioned at the forward end of the housing to receive a forward part of the tube curved from the rear part of the tube, said sleeve having an inner end and an engaging surface, means providing sealing engagement of the rearward end of said housing about said rear tube part, said sleeve extending along an axis different from the axis of the rearward opening of the housing, the inner end of the sleeve engaging and binding said outer wall of the forward part of the tube when the rearward end of the housing is sealed about the rear tube part while said engaging surface contacts a further forward part of said tube, said sleeve portion having means forming a vapor passage between said sleeve and said tube to communicate said vehicle tank with said chamber.

* * * * *